United States Patent [19]

Valkama

[11] 4,219,383

[45] * Aug. 26, 1980

[54] PRESS SECTION OF A PAPER MACHINE

[76] Inventor: Paavo J. Valkama, Leppäluoto B 1, 68610 Leppäluoto, Finland

[ * ] Notice: The portion of the term of this patent subsequent to Mar. 11, 1997, has been disclaimed.

[21] Appl. No.: 878,756

[22] Filed: Feb. 17, 1978

[30] Foreign Application Priority Data

Feb. 18, 1977 [FI] Finland ..... 770542

[51] Int. Cl.[2] ..... D21F 3/04

[52] U.S. Cl. ..... 162/360 R; 162/305; 162/360 DP

[58] Field of Search ..... 162/360 R, 360 DP, 359, 162/305, 281, 274, 206, 205, 113, 111

[56] References Cited

U.S. PATENT DOCUMENTS 2,653,523 9/1953 Hornbostel ..... 162/360 R X
3,694,311 9/1972 Skeppstedt ..... 162/305 X
4,059,482 11/1977 Kankaanpaa et al. ..... 162/360 R X

FOREIGN PATENT DOCUMENTS 1212473 11/1970 United Kingdom ..... 162/111

*Primary Examiner*—Richard V. Fisher
*Attorney, Agent, or Firm*—Steinberg & Blake

[57] ABSTRACT

A paper machine has a press section for dewatering a web, this press section including at least three consecutive press nips and a common endless fabric, in the form of a suitable wire or felt, traveling through all three press nips for conveying a web consecutively therethrough. At the first two of the three consecutive press nips there is an additional fabric structure in the form of one or two endless fabrics in the form of suitable wires or felts, which engage the web at the first and second press nips at the side of the web opposite from the common fabric. However, the additional fabric structure is spaced from that part of the web which travels from the first to the second press nip.

8 Claims, 4 Drawing Figures

PRESS SECTION OF A PAPER MACHINE

BACKGROUND OF THE INVENTION

The present invention relates to paper machines and in particular to a press section for dewatering a web which may be a suitable paper, cardboard, or the equivalent thereof, this press section having at least three consecutive press nips defined by suitable rolls while including a common endless fabric means in the form of a suitable felt or wire which travels through all of the press nips with the web adhering to this common fabric means so as to be conveyed thereby through the three press nips. On the other hand, at least at the first two press nips the web is engaged by an additional fabric means so that a double-felt action is provided at the first two press nips.

In the manufacture of certain types of paper, cardboard, or equivalent products, it is desirable to carry out the dewatering in such a way that the original web dimension, its length among others, is maintained as nearly unchanged as possible.

When manufacturing paper to be used in bags, for example, the paper web formed on a wire section is conveyed through the press section in such a way that an attempt is made to prevent the web from being subjected in the press section to stresses which might result in elongation of the web. The same considerations apply to the manufacture of stretchable types of paper in those instances where the web has been mechanically contracted or shortened prior to the press section.

On the other hand, the press section should be constructed in such a way that when the web travels beyond the press section the web has as uniform a moisture content as possible both in the longitudinal machine direction of the web as well as in the transverse cross-machine direction. Such a requirement with respect to the uniformity of the moisture is encountered, for example, in the manufacture of bag paper, particularly of so-called wet-upset types of paper which are conveyed through a multiple cylinder drying section while applying to the web an absolute minimum of tension as by utilizing so-called slack runs. The same requirement is encountered in the event that the web is treated in a half-wet state in one way or another as by being worked, for example, with press or micro-creping means.

The construction and operation of the press section also influences the quality of the web, for example the quality of the surface of the paper web. If it is possible to carry out the dewatering of the web for the most part by pressing the web in between felts, then it is possible to avoid an increase in the smoothness of the paper surfaces, and such a lack of smoothness is important, for example, in the case of bag paper. In fact, all desired surface characteristics on both surfaces of the web may be efficiently influenced by way of the quality of the felts.

SUMMARY OF THE INVENTION

One of the objects of the present invention is to provide a press section capable of treating a fiber web in such a way that it can be rendered uniformly dry to an extent sufficient to withstand stresses which arise from detaching and transporting the web beyond the press section.

It is also an object of the present invention to provide a press section which will achieve the highest possible dry matter content of the web subsequent to the press section.

More detailed objects of the invention and advantages derived thereby will be apparent from the description which follows.

The objects of the invention are achieved by way of a press section of the invention according to which the fiber web adheres at the first press nip of the press section to a common endless fabric means in the form of a suitable felt or wire which conveys the web through the first press nip and through at least two additional press nips with a complete wet fiber web being formed in advance of the first press nip on a planar wire or other former. At the first two press nips of the press section the web is engaged at its side opposite from the common fabric means by an additional fabric means in the form of a second felt or wire fabric which is common to the first two press nips and which does not engage the web traveling from the first to the second press nip, or in the form of separate endless felts or wire fabrics which are respectively situated at the first and second press nips.

As a result of the features of the present invention the smoothness of the surfaces may be regulated almost exclusively by way of the particular felt or wire fabrics which are utilized.

In the press section of the invention the web is caused to adhere to an endless felt or wire fabric by a conveying the web to the first press nip where such attachment takes place by utilizing a suitable pressure. At the first press nip as well as the subsequent press nips dewatering takes place. The common fabric means which travels through all of the press nips serves to support the web which continuously adheres thereto while traveling through successive nips.

The additional fabric which engages the web at the first press nip is guided away from the web subsequent to the first press nip, and this fabric may again be guided to the second press nip or a further endless fabric means may be utilized for this purpose.

At each of the press nips the structure of the endless fabric means and of the press section, particularly the construction of the press rolls thereof, may be varied with a view to influencing the dewatering quantitatively and also with a view to controlling the direction of dewatering.

The web is subjected to a number of press nips sufficient to achieve a dry matter content which is sufficiently great to enable the web to tolerate, unchanged, the further treatment of the web such as the drying thereof, for example. The number of press nips will be determined by the speed and thickness of the web, the quality of the pulp stock, etc.

The quality of the endless fabrics is utilized to influence not only the dewatering capacity of the press section but also the quality of the web surfaces. The adhering of the web to the endless fabric means through all of the press section treatment is carried out by proper selection of the felt and press structures. It is possible to utilize for the purpose of adhering the web, for example, a press provided with a suction roll.

The water which is removed from the web in the press section may be directed so as to escape through the fabric means as may be desired. At the press section the water departs from the web to enter the felt which is pressed against a roll which is capable of receiving water. Such rolls are, for example, suction rolls, grooved rolls, rolls which may be furnished with a separate fabric wire, rolls having blind holes drilled in the shell thereof, etc. The dewatering takes place from both surfaces of the web in the event that both rolls at a given press nip are suction rolls, for example.

With the press section of the invention the water is predominantly directed into a felt which is detached from the web at the nip where the latter felt engages the web, this arrangement being most favorable with respect to achieving the desired dry matter content of the web. It is possible in this way to avoid subsequent wetting of the web after the latter press nip, and the water quantity which is jointly contained in the fabric and web and traveling to the next press nip will be maintained at an absolute minimum.

Such a solution to the problem is achieved if the fabric which conveys the web from one nip to the next engages a smooth-surface press roll while, on the other hand, the opposite press roll is capable of accepting water, being, for example a suction roll or a grooved roll. With such a construction the fluid pressure will cause the water to be discharged toward the latter water-accepting roll through the interposed fabric which is detached from the web subsequent to the nip where this latter fabric engages the web.

It is possible further to reduce the fluid pressure in the nip by reducing the water content of the additional fabric means which becomes detached from the web subsequent to a given press nip by conveying the latter fabric means to a separate dewatering means. For this latter purpose it is possible to utilize suction or recessed surface press rolls or a so-called felt suction box. Thus the water content of the fabric arriving at a given press nip will be at a minimum.

It is thus understood that the fiber web that travels at the successive nips, with the possible exception of the last nip, travels between fabrics in the form of suitable felt or wire without directly engaging the press rolls themselves. However, at the last press nip the construction may be such that the web can directly engage one of the press rolls at this last press nip.

Commercial press felts or wires always have certain irregularities which affect the operation of the press and the uniformity of the dry matter in the web. Regular transverse or longitudinal moisture content variations are undesirable because they give rise to temperature differences at the surface of the drying cylinders and thus the effect of such variations is undesirably increased. Simultaneous use of several felts of different lengths at a given nip minimizes the possibility for irregular moisture variations to occur.

With the construction of the invention the uniformity of the dry matter is improved by providing an additional wire on endless felt fabric around one or more than one of the press rolls where this latter further fabric is required to pass between the particular press roll and the common fabric means which conveys the web to the successive press nips. This extra fabric means affords the possibility of utilizing at the nip where it is situated high pressing forces which may be up to 200 to 300 kg per cm without incurring any particular detriment in the operation of the press section or the quality of the paper. This particular circumstance becomes even more significant if the trend toward utilizing lightweight felt for web-carrying purposes continues. Such an extra felt is particularly useful at the last press nip if the web remains in contact with a smooth-surface press roll at this last press nip with a view to facilitating handling of waste.

BRIEF DESCRIPTION OF DRAWINGS

The invention is illustrated by example in the accompanying drawings which form part of this application and in which.

DESCRIPTION OF PREFERRED EMBODIMENTS

Figure 1:
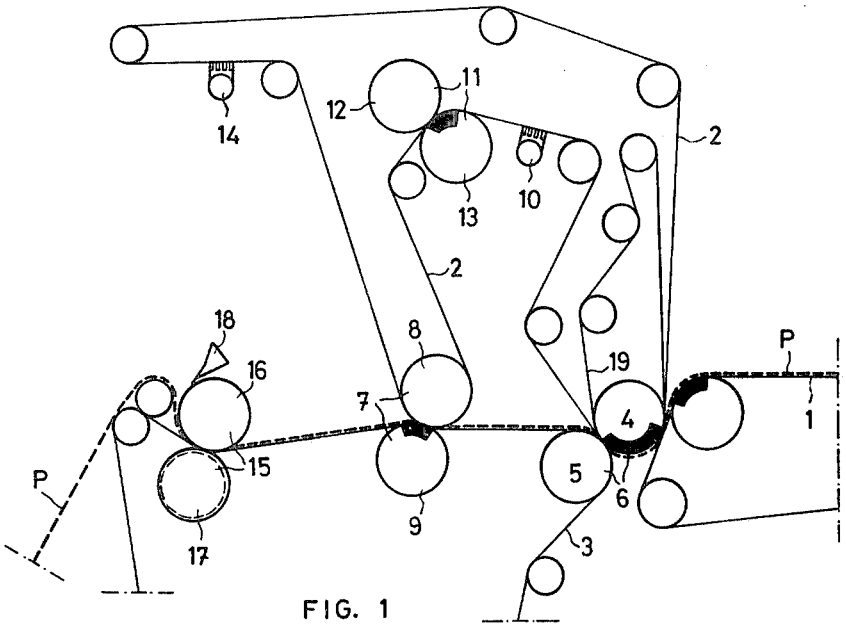
FIG. 1 is a schematic elevation illustrating one embodiment of the invention.

Referring to FIG. 1, the paper web has been formed in a known way at the wire 1. Thereafter the web is contacted by the endless fabric means 2 in the form of a suitable felt which laps the nip-suction roll 4. As a result of the suction at the roll 4, the web P is detached from the wire 1 and adheres as a result of suction to the outer surface of the felt 2 being carried thereby to the first press nip 6 of the press section illustrated in FIG. 1. This first press nip 6 is defined by the suction roll 4 and a lower pressure roll 5. At this first press nip 6 there is an endless fabric means 3 in the form of a suitable wire or felt, this being a common endless fabric means in that it is common to the several successive press nips of the illustrated press section.

The roll 5 which is situated within the felt 3 is a smooth-surface roll, while the roll 4 which is within the loop of the endless felt 2 is a suction roll, this roll 4 in addition being situated within the loop of a further so-called fabric wire 19 which laps around the suction roll 4 in the manner illustrated in FIG. 1, being situated between the roll 4 and the endless fabric means 2. As a result of this feature the de-watering of the web P at the first press nip 6 toward the felt 2 is enhanced.

At the first press nip 6 the web P becomes attached to the felt 3 as a result of the construction of the press section and the quality of the felts 2 and 3. The web P and the felt 3, adhering to each other, travel together to the second press nip 7 and then beyond the latter to the third press nip 15.

At the second press nip 7 the lower press roll 9 is a suction roll situated within the common fabric means 3 engaging the latter. As a result of the suction applied at the roll 9 the adhering of the web P to the felt 3 is assured. The upper press roll 8 at the second press nip 7, within the loop of the endless felt 2, is a smooth-surfaced roll. Thus at the second press nip 7 with the embodiment of FIG. 1 the web also travels between the felts 2 and 3.

The felt 2 is dried before reaching the second press nip 7, this drying being carried out by way of a felt suction box 10 and/or drying press rolls 12,13 forming the drying press 11, the roll 13 being a suction roll.

Subsequent to the nip 7, the felt 2 is again dried, a felt suction box 14 being provided for this purpose. Thus the felt 2 is dried before returning to the first press nip 6. Thus it will be seen that the structure includes not only the common fabric means 3 but the additional fabric means 2 which engages the web at the first and second press nips while being guided away from the web to remain out of contact therewith as the web travels from the first to the second press nip.

At the third press nip 15 the lower roll 17 is a roll having a recessed surface, being situated within the loop of the common fabric means 3, this roll 17 being a grooved roll or a Venta-Nip roll. The upper press roll 16 at the last press nip is a smooth-surfaced roll, and the web P travels at this last press nip 15 between felt 3 and the roll 16, adhering to the latter subsequent to the third press nip. Between the first press nip 6 and the last press nip 15 there may be additional intermediate press nips 7. The roll 16 is cleaned by the doctor 18, and subsequent to the roll 16 the web P is guided as illustrated to the drying section while the endless common fabric means 3 is returned to the first press nip.

Figure 2:
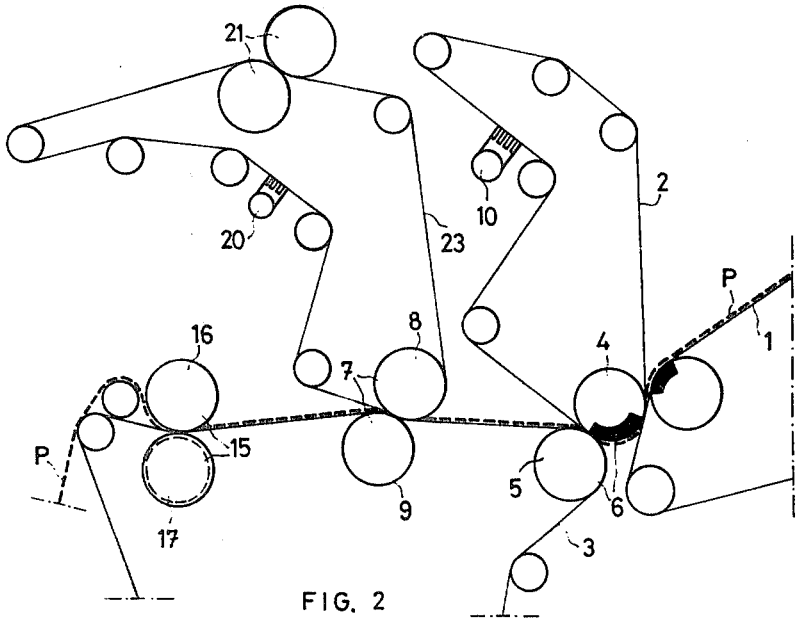
FIG.2 is a schematic elevation illustrating another embodiment of the invention.

With the embodiment of FIG. 2 the travel of the web P to the press section is similar to the arrangement of FIG. 1. Thus in FIG. 2 also the web P adheres to the common endless fabric means 3 which conveys the web to the successive press nips of the press section. The first press nip 6 of FIG. 2 has a suction press nip where water travels from the web to the suction roll 4. In the embodiment of FIG. 2 the additional fabric means, instead of including a single endless felt or wire which is common to the first and second press nips, includes only the single endless fabric means 2 which travels only to the first press nip in the manner illustrated in FIG. 2. This endless fabric means 2 of FIG. 2, in the form of a suitable fabric or wire, is dried by the felt suction box 10.

At the second press nip in FIG. 2 there is a recessed or grooved roll 8 toward which the water escapes, the lower press roll 9 at the second press nip 7 of FIG. 2 being a smooth-surfaced roll. The additional endless fabric means of FIG. 2 includes for the second press nip a separate endless fabric means 23 in the form of a suitable felt or wire, this felt or wire 23 being dried by the felt suction box 20 and/or a pair of press rolls 21, one of which at least is a recessed surface roll.

The third press nip 15 of FIG. 2 is identical with that of FIG. 1. Of course in FIG. 2 also there may be additional intermediate press nips 7.

Figure 3:
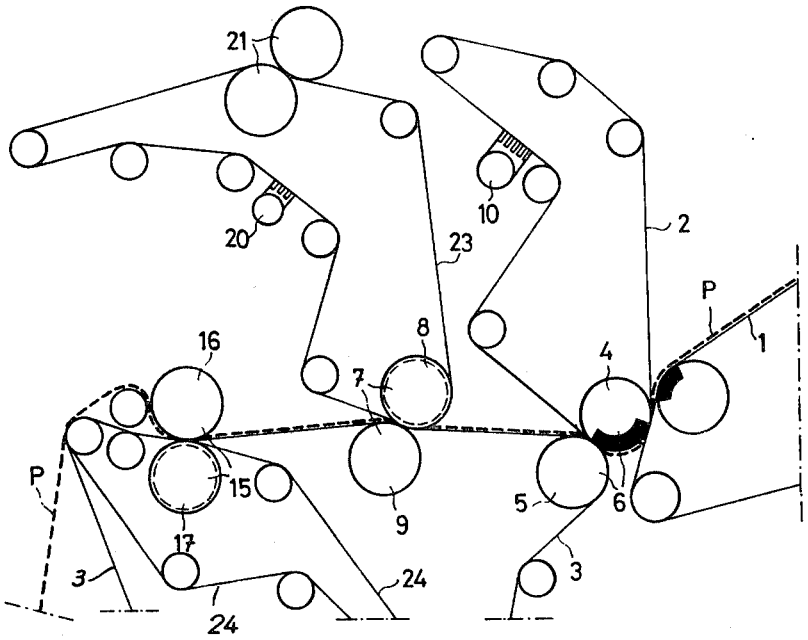
FIG. 3 is a schematic elevation of a third embodiment of the invention.

The arrangement illustrated in FIG. 3 is entirely similar to FIG. 2 except that the third press nip 15 in FIG. 3 includes a further endless fabric means 24 in the form of a suitable wire or felt. The lower grooved roll 17 of the third press nip 15 is situated within the loop of the further endless felt 24, pressing the latter against the common endless fabric means 3 with the web being situated between the latter and the roll 16.

Figure 4:
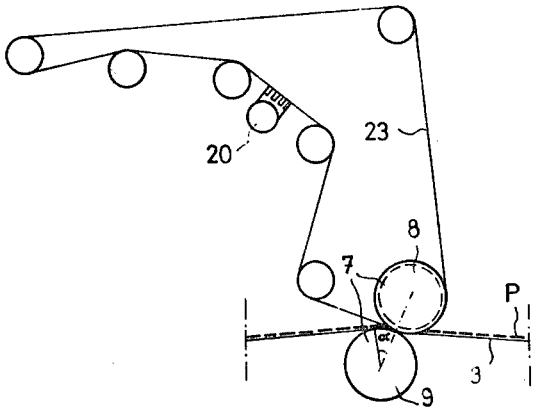
FIG. 4 is a schematic elevation illustrating a part of a press section of the invention.

Referring now to FIG. 4, by way of example, the intermediate press nip 7 is illustrated therein, this press nip having the upper grooved press roll 8 and the lower smooth-surfaced roll 9. The web P is of course compressed between the common fabric means 3 and the endless fabric 23 in the case of FIG. 4. The roll 8 of FIG. 4 instead of being grooved may be formed with blind drilled holes or other recessed structures.

It will be noted from FIG. 4 that the plane which contains the axes of the rolls 8 and 9 is inclined, having the illustrated angle $\alpha$ with respect to a vertical plane. As a result of this feature the common endless fabric means 3 together with the web P thereon lap the smooth-surfaced roll 9 immediately subsequent to the press nip 7 through a predetermined angle, this being the angle $\alpha$ indicated in FIG. 4. With a view to assuring proper functioning of the press section, this angle $\alpha$ should be at least 5°. In practice an appropriate angle of lap for the angle $\alpha$ will be on the order of 7° to 30°, depending upon the selection of the recessed surface of the upper roll 8. The upper limit of this angle of lap has no significance in practice because the felt 3 and the web P adhering thereto must be carried to the next press nip, so that it is clearly advantageous to utilize a relatively small extent of the lap, yet one which assures the continuous adherance of the web P to the common endless fabric means 3. If, however, this lap angle is less than 5°, then a positive adhering of the web P to the fabric 3 is no longer assured.

The operating conditions prevailing in the machine which manufactures the web will determine the number of nips required and the particular construction thereof as well as the number of felt drying units and felt suction boxes.

The advantages of the press section of the invention are believed to be clear. The wet fiber web which has been separately formed on a planar wire or in another type of former and which has been upset or creped before reaching the first press nip in the press section of the invention is capable of being conveyed through the entire press section in a reliable fail-safe manner without elongation of the web.

Subsequent to the press section of the invention the extent of dry matter in the web is sufficient for assuring the detaching of the web from the press section and its further transportation in a fully reliable manner. The uniformity of the dry matter in the web is extremely good and it is as independent of the quality of the felts as possible. It is possible to change the surface characteristics of the web by selecting suitable felts.

If desired the press section may be constructed entirely without suction rolls so that the investement costs and operating costs can be reduced. Also, if desired, press rolls with rubber coatings may be totally omitted. Moreover it is possible by utilizing double-felted press nips, shown at the first and second press nips above, at the same time to increase the extent of pressure at the press nips considerably so as to achieve a high dry matter content and a high quality paper.

When manufacturing bag paper on a modern paper machine utilizing the structure of the invention, it has been found that at least three main dewatering press nips are required. By means of these three press nips a high dry matter content on the order of 37 to 38% has been achieved as measured subsequent to the press section. At the same time, the length of the web has been increased, compared to the length thereof measured on the forming wire section, by less then 0.5%, whereas with conventional constructions this elongation is at least four times as great.

The press section of the invention adheres the paper web to the common endless fabric means 3 at the beginning of the press section at the first press nip, and the web is not detached from the common fabric means 3 until the web is in a condition dry enough to tolerate in a fully reliable manner the stresses arising from the detaching operation and from the further transporting of the web, such detachment taking place subsequent to the third press nip at the earliest. At the same time the common endless fabric means 3 and the additional endless fabric means formed either by a single endless felt or wire 2 in the case of FIG. 1 or by a pair of additional felts or wires 2 and 23 results in an arrangement where at the first and second press nips, at least, the web is interposed between a pair of felts.

Only a few embodiments of the invention have been presented above. It will be obvious to those skilled in the art that numerous modifications can be made within the inventive concept defined by the claims which follow.

What is claimed is:

1. In a paper machine, a press section for removing water from a web, said press section having at least three nips and a common endless fabric means common to said three nips for conveying a web consecutively through said three nips, and additional endless fabric means situated at the first two of said three consecutive press nips for engaging the web at said first two press nips at a side of said web opposite from the side thereof engaged by said common fabric means, said additional endless fabric means being spaced from that part of the web which travels from the first to the second and from the second to the third of said three consecutive nips and wherein each of said first and second press nips includes press rolls, one of which at each of the latter press nips engages said additional endless fabric means and another of which at each of said first and second press nips engages said common fabric means, and further wherein the press roll at said second press nip which engages said common fabric means is a smooth-surfaced roll while the press roll at said second press nip which engages said additional fabric means has a recessed surface for receiving water from the web.

2. The combination of claim 1 and wherein a drying means cooperates with said additional endless fabric means for drying the latter prior to engagement of said additional endless fabric means with the web at said first and second press nips.

3. The combination of claim 1 and wherein said press roll at said first press nip which engages said common fabric means is a smooth-surfaced roll.

4. The combination of claim 3 and wherein said common fabric means laps said smooth-surfaced roll at said second press nip immediately subsequent to said second press nip through an angle of at least 5°.

5. The combination of claim 4 and wherein the angle of lap of said common fabric means at said smooth-surfaced press roll of said second press nip is in the range of 7°-30°.

6. The combination of claim 1 and wherein at least one of the three press nips includes a press roll situated within the loop of said common endless fabric means adjacent to the latter, and a third endless fabric means situated within said loop of said common fabric means and traveling between the latter and the latter press roll while engaging the latter press roll and said common fabric means.

7. The combination of claim 1 and wherein said additional endless fabric means includes only a single endless fabric means.

8. The combination of claim 1 and wherein said additional endless fabric means includes a pair of separate fabric means.

* * * * *